US011325386B2

(12) United States Patent
Okumura et al.

(10) Patent No.: US 11,325,386 B2
(45) Date of Patent: May 10, 2022

(54) LIQUID CONTAINER DEVICE AND LIQUID EJECTING APPARATUS

(71) Applicant: SEIKO EPSON CORPORATION, Tokyo (JP)

(72) Inventors: Hideki Okumura, Shiojiri (JP); Toshiyuki Ochiai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 21 days.

(21) Appl. No.: 17/125,121

(22) Filed: Dec. 17, 2020

(65) Prior Publication Data

US 2021/0187955 A1 Jun. 24, 2021

(30) Foreign Application Priority Data

Dec. 18, 2019 (JP) ..... JP2019-228030

(51) Int. Cl.
*B41J 2/175* (2006.01)

(52) U.S. Cl.
CPC ..... *B41J 2/17509* (2013.01)

(58) Field of Classification Search
CPC ..... B41J 2/17509
See application file for complete search history.

(56) References Cited

U.S. PATENT DOCUMENTS 10,308,029 B2 6/2019 Kudo et al.
2012/0044285 A1* 2/2012 Ogasawara ..... B41J 2/17566 347/6

FOREIGN PATENT DOCUMENTS

JP 2018-069705 A 5/2018
JP 2019-123169 A 7/2019
JP 2019-181834 A 10/2019

* cited by examiner

*Primary Examiner* — Justin Seo
(74) *Attorney, Agent, or Firm* — Oliff PLC

(57) ABSTRACT

A liquid container device includes: a liquid container having an inlet; a casing in which the liquid container is housed; and a cap lever having a cap configured to seal the inlet. The liquid container has an upper surface, and a visualization surface. The casing includes a cover configured to pivot and that protects the upper surface, a cap lever-engaging portion, a visualization portion having an opening, and a wall portion disposed on the +Z direction side with respect to the visualization portion. The cap lever includes an engageable portion configured to be engaged with the cap lever-engaging portion, and a body extending in the +Y direction from the engageable portion. A surface disposed so as to face the cover of the body is planar, and an end of the body in the +Y direction is separated from an end of the wall portion in the +Z direction.

6 Claims, 16 Drawing Sheets

LIQUID CONTAINER DEVICE AND LIQUID EJECTING APPARATUS

The present application is based on, and claims priority from JP Application Serial Number 2019-228030, filed Dec. 18, 2019, the disclosure of which is hereby incorporated by reference herein in its entirety.

BACKGROUND

1. Technical Field

The present disclosure relates to a liquid container device and a liquid ejecting apparatus including the liquid container device.

2. Related Art

For example, a known liquid ejecting apparatus includes a liquid container unit (liquid container device) capable of being replenished with a liquid, and a liquid ejecting unit configured to print an image onto a medium by ejecting a liquid supplied from the liquid container device (for example, JP-A-2018-069705).

The liquid container device described in JP-A-2018-069705 includes a liquid container configured to contain a liquid, a casing configured to contain the liquid container, an inlet through which a liquid is poured into the liquid container, and a stopper (cap lever) configured to open and close the inlet. The cap lever includes a grip projecting vertically upward.

In the liquid container device described in JP-A-2018-069705, a user holds the grip, opens the cap lever, and pours a liquid into the liquid container.

However, in the liquid container device described in JP-A-2018-069705, the grip projecting vertically upward is disposed on the cap lever, and a user opens or closes the cap lever by holding the grip. Thus, an additional space has to be formed in the vicinity of the inlet. Accordingly, it is difficult to reduce the length in the vertical direction (height direction) of the liquid container device and to reduce the size of the liquid container device in the height direction.

SUMMARY

A liquid container device includes: a liquid container having an inlet through which a liquid is poured from a replenishment container; a casing in which the liquid container is housed; and a cap lever configured to pivot and having a cap configured to seal the inlet. The liquid container has an upper surface on which the inlet is disposed, and a visualization surface via which the liquid is visible and that is positioned on a side of a first direction with respect to the upper surface. The casing includes a cover that is configured to pivot and that protects the upper surface, an engaging portion disposed between the cover and the upper surface, a visualization portion having an opening exposing the visualization surface, and a wall portion disposed on a side of a direction opposite to the first direction with respect to the visualization portion. The cap lever includes an engageable portion configured to be engaged with the engaging portion, and a body extending in a second direction crossing the first direction from the engageable portion. A surface disposed so as to face the cover of the body is planar, and an end of the body in the second direction is separated from an end of the wall portion in the direction opposite to the first direction.

A liquid ejecting apparatus includes: a liquid ejecting unit configured to eject a liquid; and the liquid container device in which the liquid is contained.

DESCRIPTION OF EXEMPLARY EMBODIMENTS

1. Embodiment 1

1.1 Overview of Recording Apparatus

Figure 1:
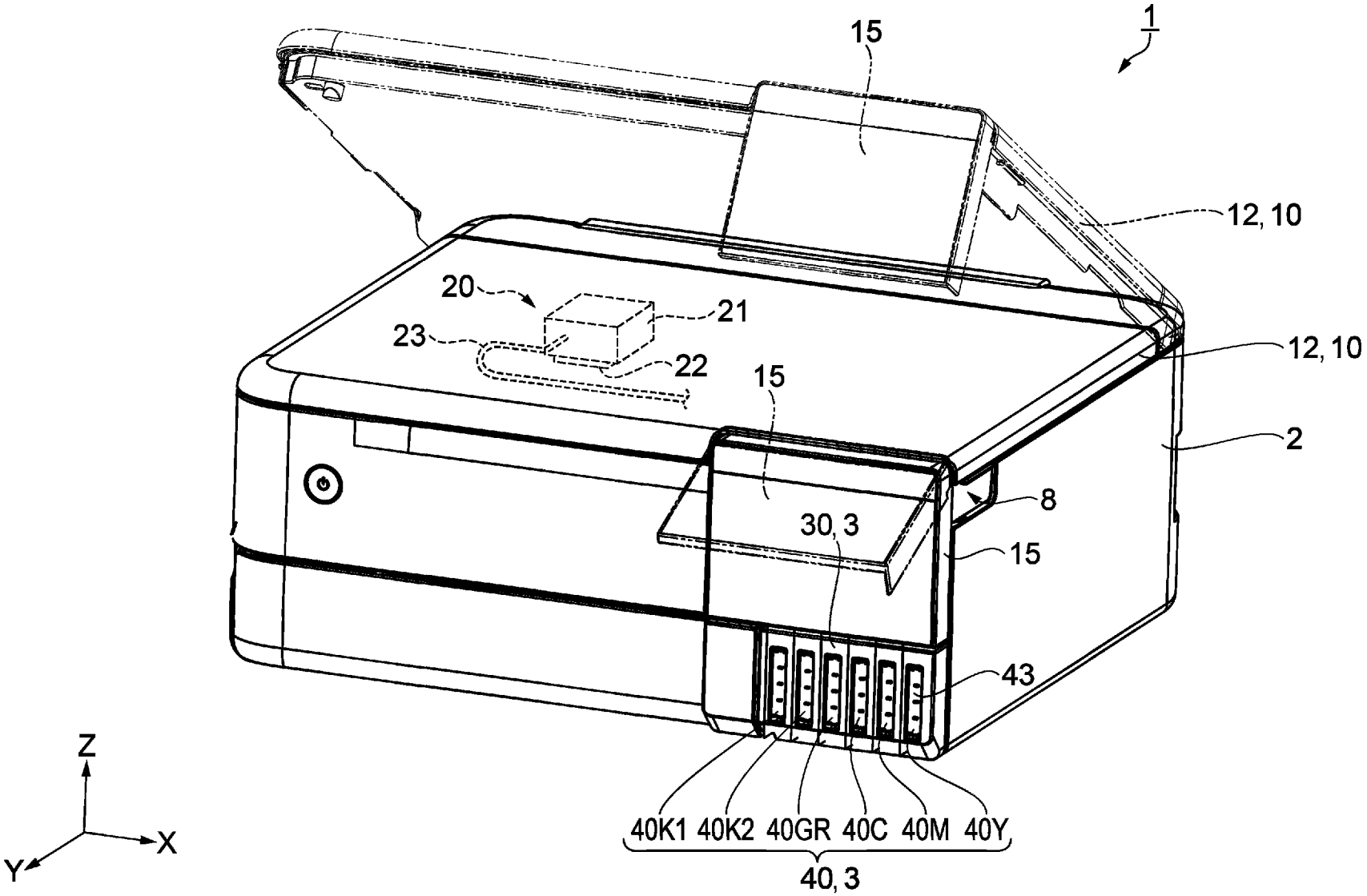
FIG. 1 is a perspective view of a recording apparatus according to Embodiment 1.
Figure 2:
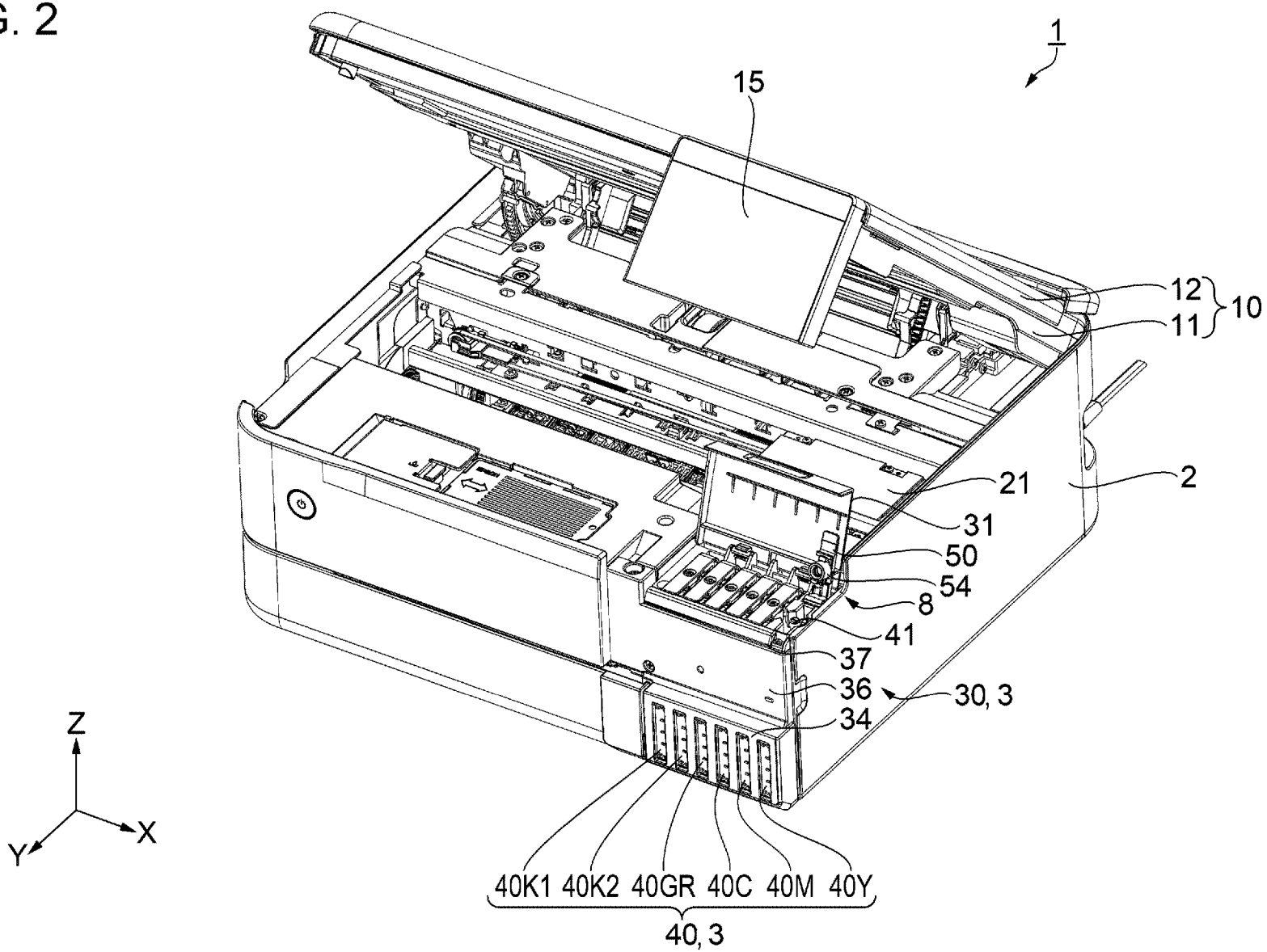
FIG. 2 is another perspective view of the recording apparatus according to Embodiment 1.
Figure 3:
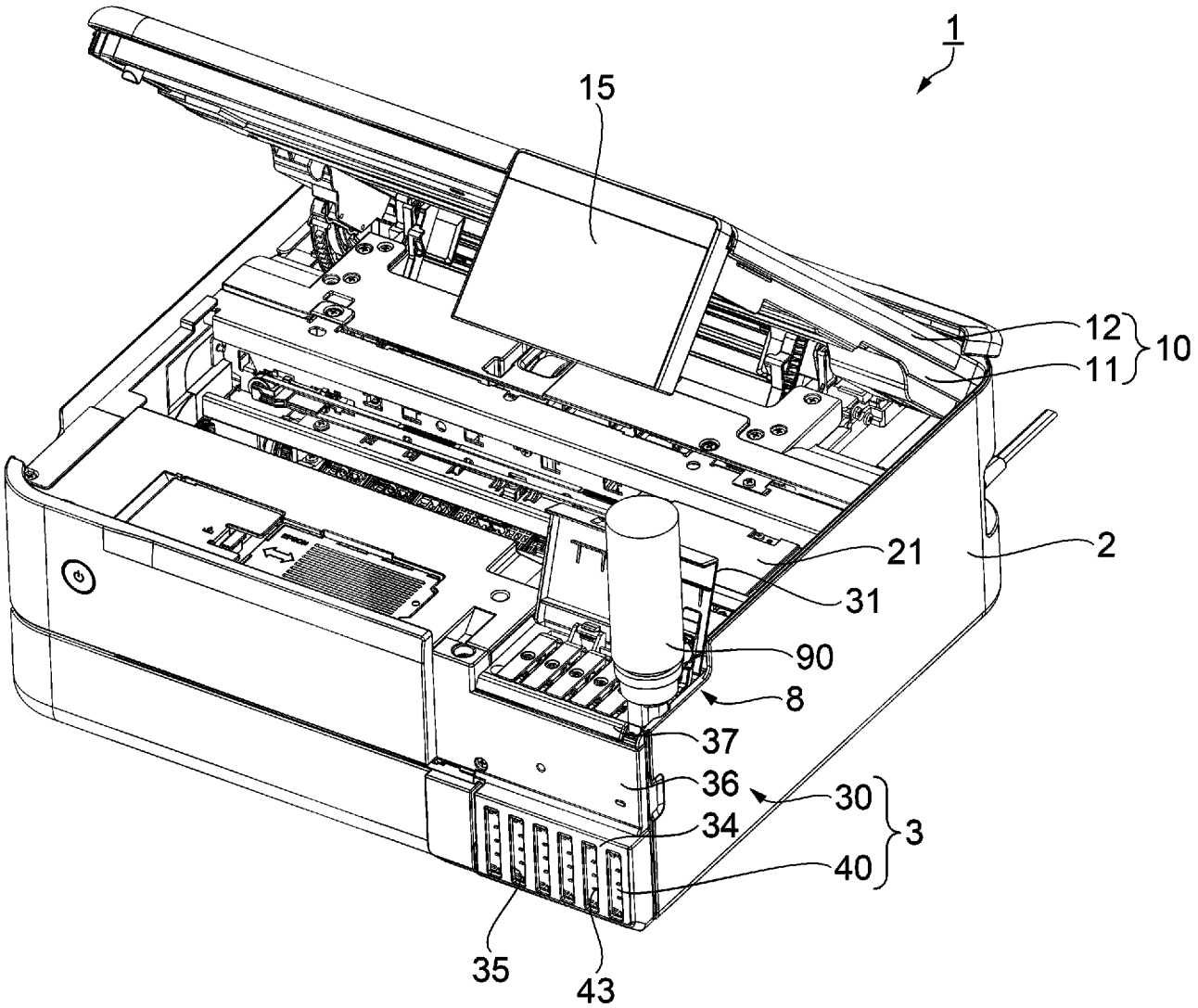
FIG. 3 is still another perspective view of the recording apparatus according to Embodiment 1.
Figure 3:
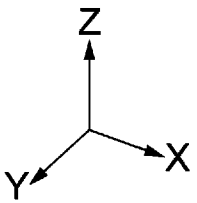

FIGS. 1 to 3 are perspective views of a recording apparatus 1 according to Embodiment 1. FIG. 1 illustrates a state in which a scanner unit 10 is closed with respect to an apparatus body 2. FIGS. 2 and 3 each illustrate a state in which the scanner unit 10 is open with respect to the apparatus body 2.

First, an overview of the recording apparatus 1 according to the present embodiment is described with reference to FIGS. 1 to 3. The recording apparatus 1 is an example of a liquid ejecting apparatus in the present application.

As illustrated in FIGS. 1 to 3, the recording apparatus 1 according to the present embodiment includes the apparatus body 2, which has a cuboid shape, and the scanner unit 10, which is attached to an upper portion of the apparatus body 2. The recording apparatus 1 is disposed on a horizontal plane.

In the following description, a long-side direction (width direction) of the apparatus body 2, which has a cuboid shape, is defined as the X direction, a short-side direction (depth direction) of the apparatus body 2 is defined as the Y direction, and a height direction of the apparatus body 2 is defined as the Z direction. In addition, the directions toward the tips of arrows indicating the corresponding directions are defined as the + directions, and the directions toward the base ends of the arrows indicating the corresponding directions are defined as the − directions. The plane (XY-plane) formed by the X direction and the Y direction is a horizontal plane. The −Z direction is the direction of gravity.

The −Z direction is an example of a first direction in the present application. The +Z direction is an example of the direction opposite to the first direction in the present application. The +Y direction is an example of a second direction in the present application. The −Y direction is an example of the direction opposite to the second direction in the present application.

The scanner unit 10 is disposed on an upper portion of the apparatus body 2 and is attached to and configured to pivot with respect to the apparatus body 2 (see FIGS. 1 and 2). In the scanner unit 10, a scanner housing 11, on which a document is mounted and which reads the document, and a document cover 12 are stacked in this order.

The document cover 12 is a cover that protects the scanner housing 11. As illustrated in FIG. 1 with chain double-dashed lines, the document cover 12 is configured to pivot with respect to the scanner housing 11. In addition, a display unit 15 is attached to the end of the document cover 12 in the +Y direction.

As illustrated in FIG. 1 with solid lines and chain double-dashed lines, the display unit 15 is configured to pivot, together with the document cover 12, with respect to the scanner housing 11 and is configured to be tilted with respect to the document cover 12. That is, the display unit 15 is attached to an end of the scanner unit 10 and is configured to pivot together with the scanner unit 10 and to be tilted.

The display unit 15 is formed by a liquid crystal display module having a touch screen function. The display unit 15 has a mechanism for guiding operation of the recording apparatus 1 (display function) and a function of performing various settings on the recording apparatus 1. A user can tilt the display unit 15 to a position at which the display unit 15 is easily visible to the user and can perform various settings on the recording apparatus 1 while referring to images displayed on the display unit 15. In addition, a user can tilt the display unit 15 to a position at which the user can easily touch the display unit 15 and can perform various settings on the recording apparatus 1 via the display unit 15.

In addition, a liquid container device 3 (liquid containers 40) can be replenished with a liquid from a replenishment container 90 by pivoting the display unit 15 together with the scanner unit 10 and by opening the scanner unit 10, to which the display unit 15 is attached, with respect to the apparatus body 2 (see FIG. 3).

A recording unit 20 is disposed inside the apparatus body 2. The recording unit 20 is configured to record an image onto a medium (not illustrated) by using a liquid. The recording unit 20 includes a carriage 21, a recording head 22, which is mounted on the carriage 21 and ejects a liquid onto a medium, and a tube 23, through which a liquid is supplied to the recording head 22 (see FIG. 1).

The recording head 22 is an example of a liquid ejecting unit in the present application.

A liquid to be supplied to the recording head 22 is contained in the liquid container device 3. The recording head 22 and the liquid container device 3 are coupled by the tube 23.

As described above, the recording apparatus 1, which is an example of the liquid ejecting apparatus, includes the recording head 22 (liquid ejecting unit), which ejects a liquid, and the liquid container device 3, in which a liquid is contained.

The carriage 21 is supported by a guide shaft (not illustrated) and is configured to move in a width direction of a medium crossing a transport direction in which a medium is transported. In the present embodiment, the width direction of a medium is the +X direction or the −X direction, and the transport direction of a medium is the +Y direction.

The recording head 22 is configured to move in the width direction of a medium together with the carriage 21. The recording head 22 includes a common liquid chamber (not illustrated), a pressure generating chamber (not illustrated), a piezoelectric element (not illustrated), and a nozzle (not illustrated). The recording head 22 ejects a liquid onto a medium.

The recording apparatus 1 according to the present embodiment records a desired image onto a medium by alternately repeating the operation in which the recording head 22 ejects a liquid onto the medium while moving in the width direction of the medium and the operation in which the medium is transported in the transport direction.

1.2 Overview of Liquid Container Device

Figure 4:
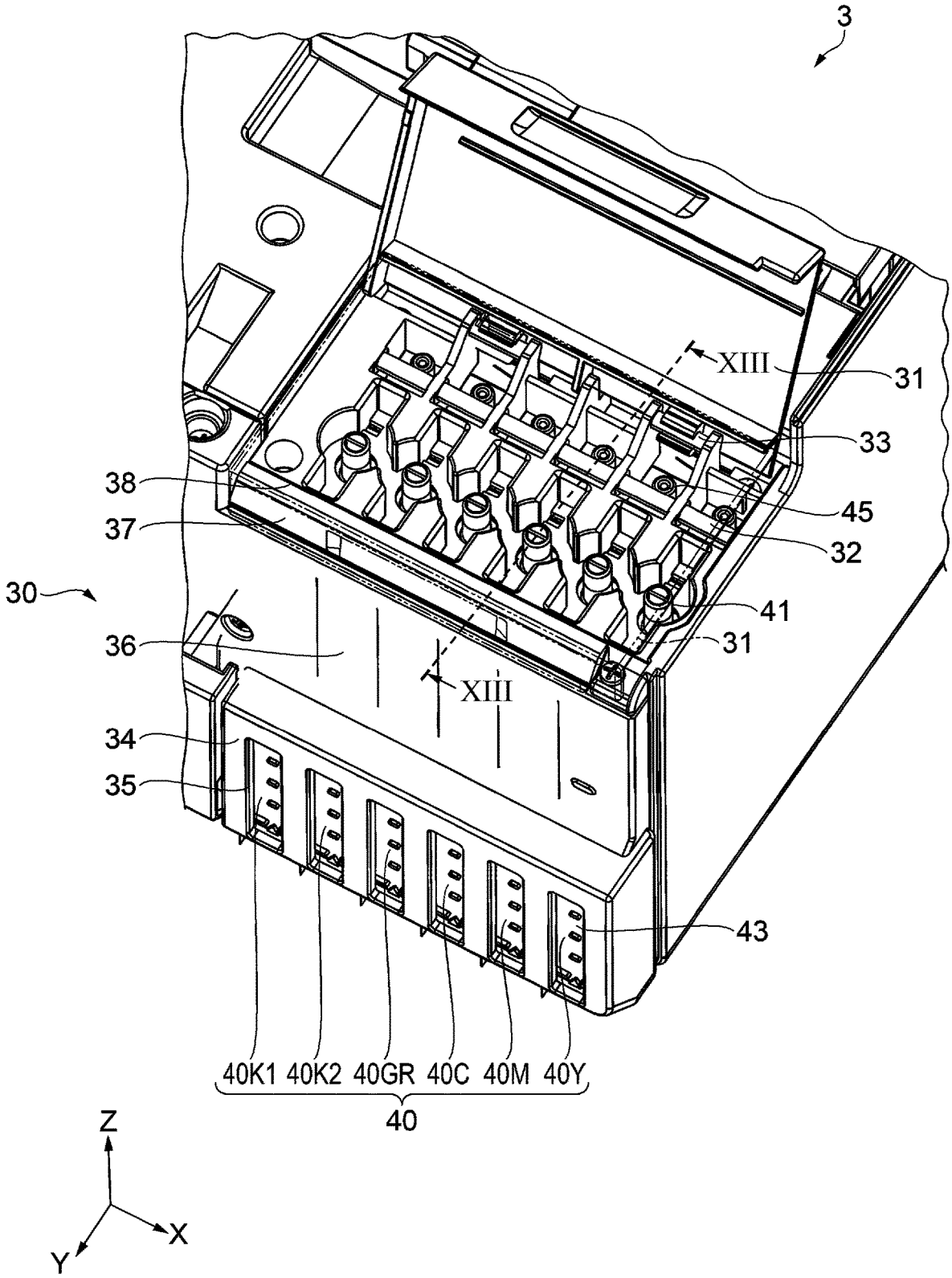
FIG. 4 is a perspective view of a liquid container device according to Embodiment 1.
Figure 5:
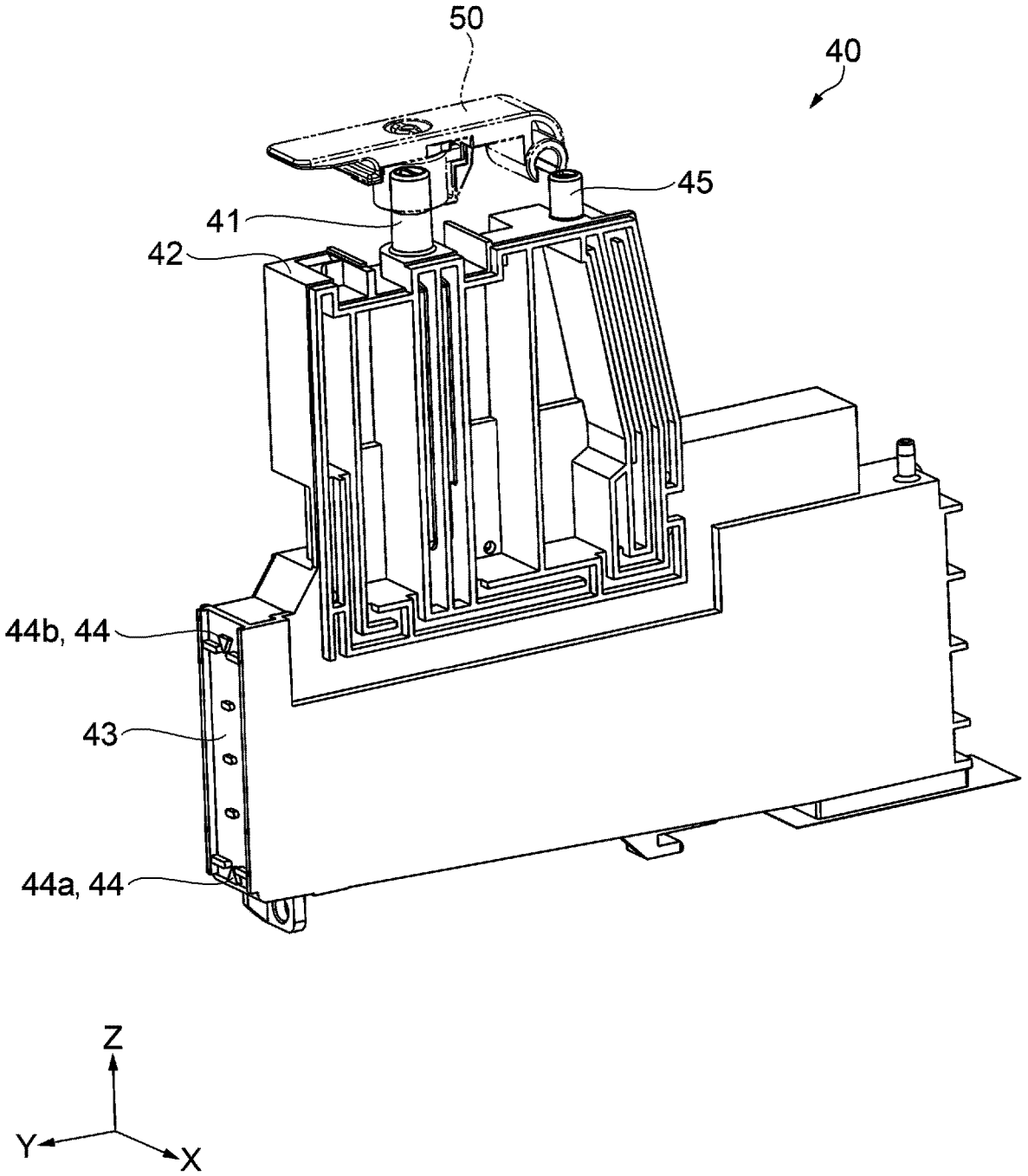
FIG. 5 is a perspective view of a liquid container.
Figure 6:
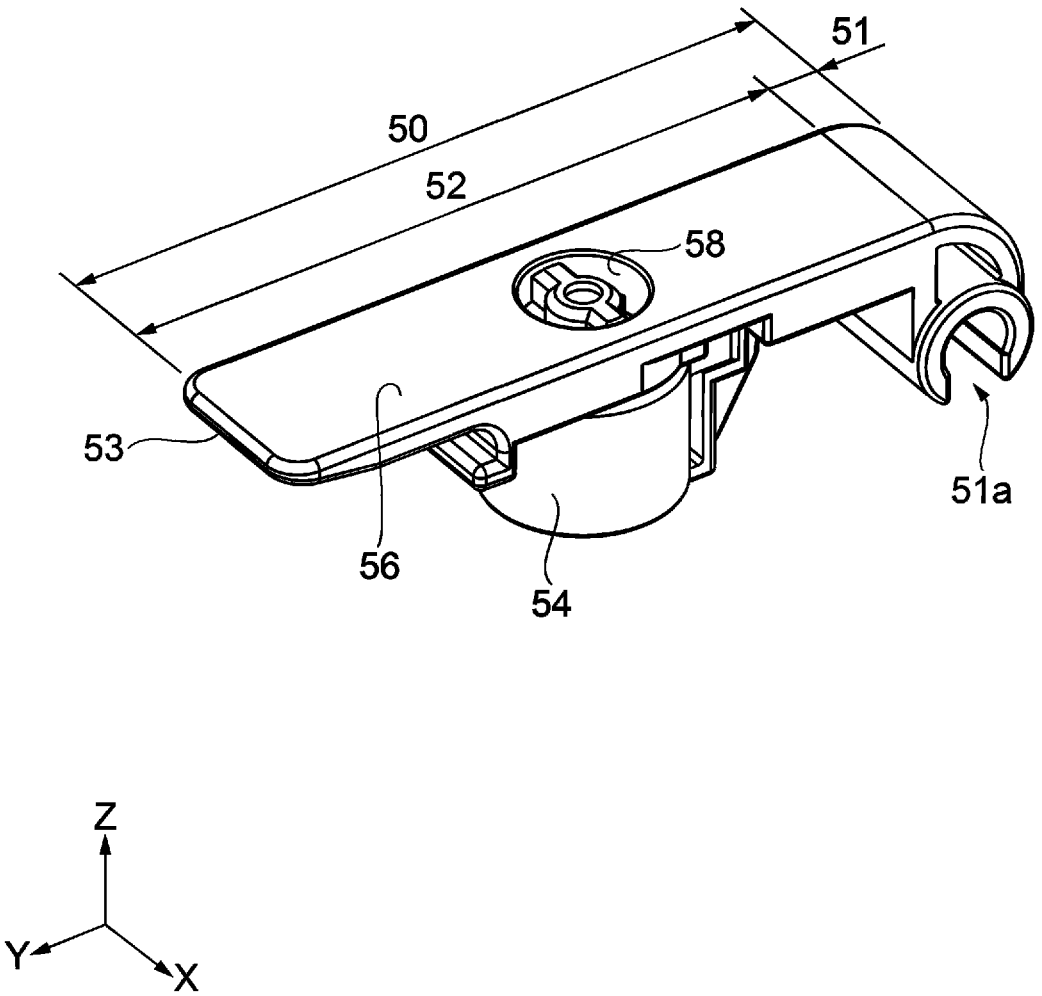
FIG. 6 is a perspective view of a cap lever.
Figure 11:
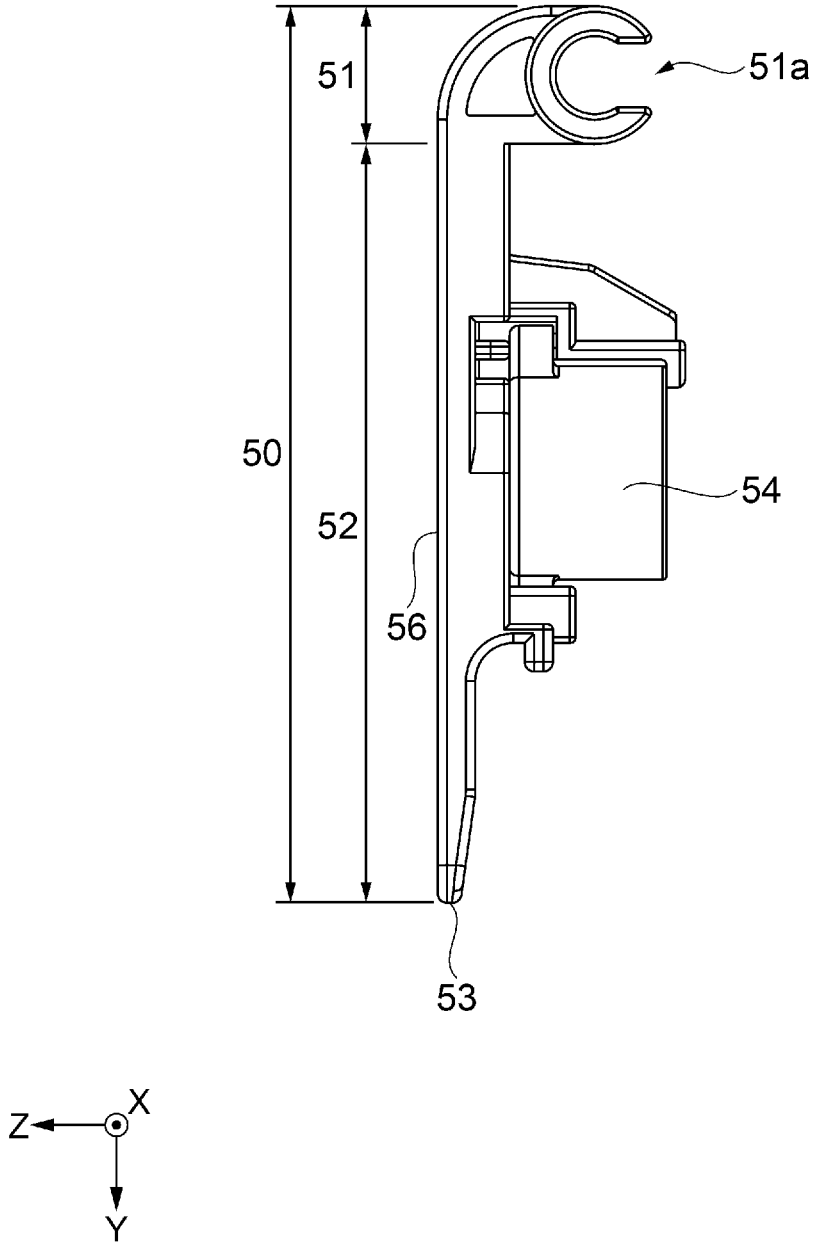
FIG. 11 is a right side view of the cap lever.
Figure 12:
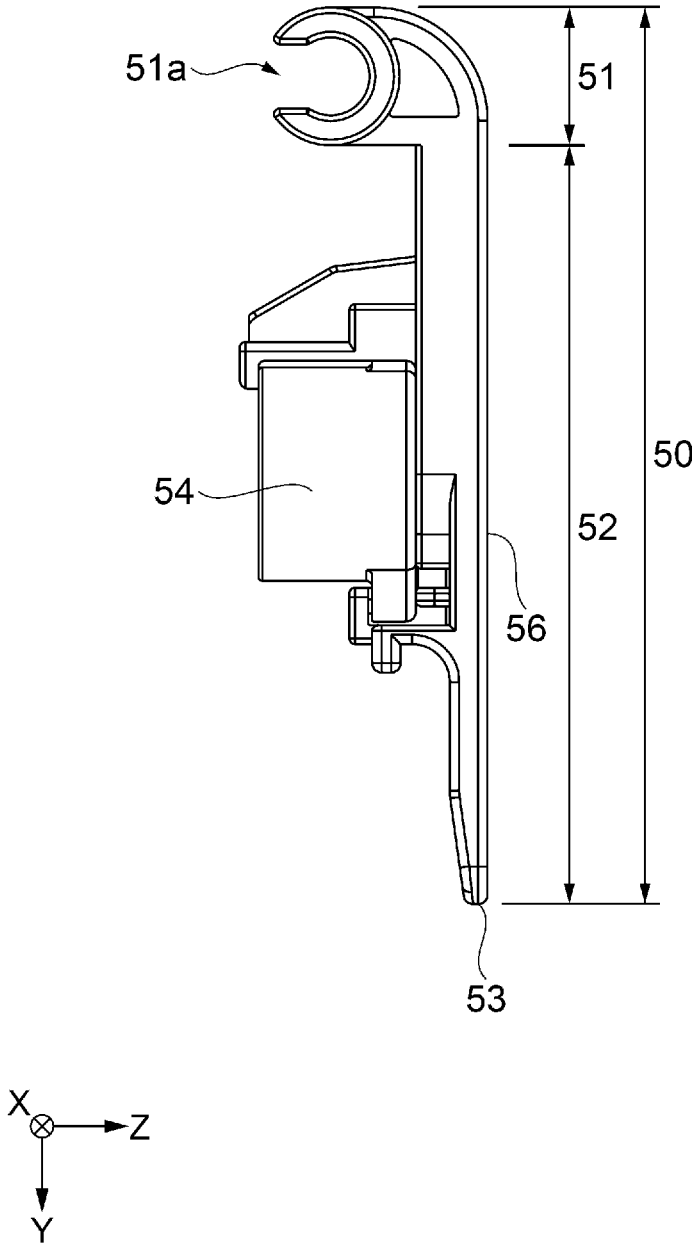
FIG. 12 is a left side view of the cap lever.
Figure 13:
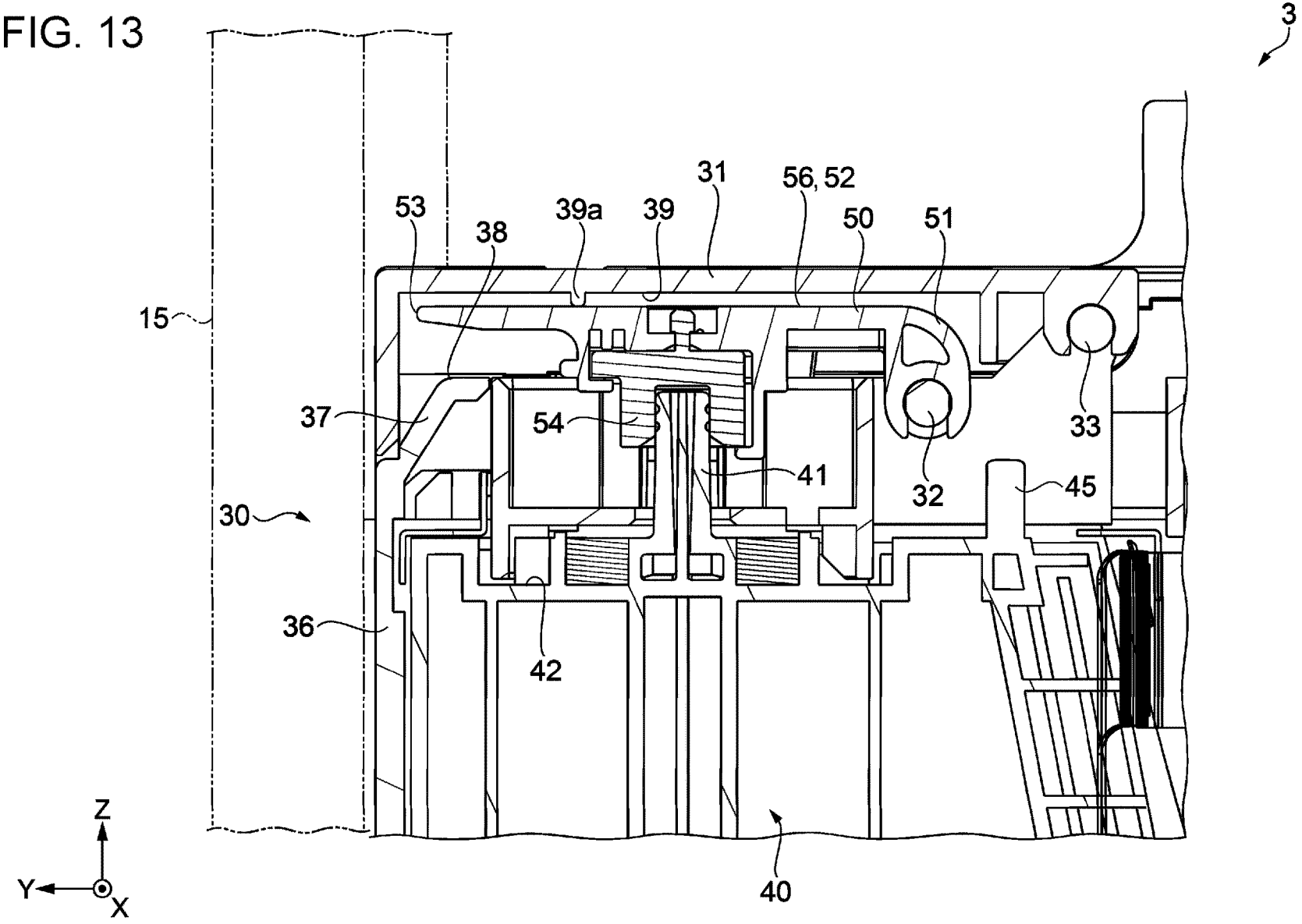
FIG. 13 is a sectional view of a main part of the liquid container device according to Embodiment 1.

FIG. 4 is a perspective view of the liquid container device 3 according to the present embodiment. FIG. 5 is a perspective view of the liquid container 40. FIG. 6 is a perspective view of a cap lever 50. FIGS. 7 to 12 are plan and elevation views of the cap lever 50 when viewed in the X direction, the Y direction, or the Z direction. FIG. 13 is a sectional view taken along line XIII-XIII in FIG. 4 and a sectional view of a main part of the liquid container device 3 according to the present embodiment.

FIG. 4 illustrates a casing 30 and the liquid containers 40, which are components of the liquid container device 3, but does not illustrate the cap lever 50, which is a component of the liquid container device 3. FIG. 5 illustrates the cap lever 50 with chain double-dashed lines.

Figure 7:
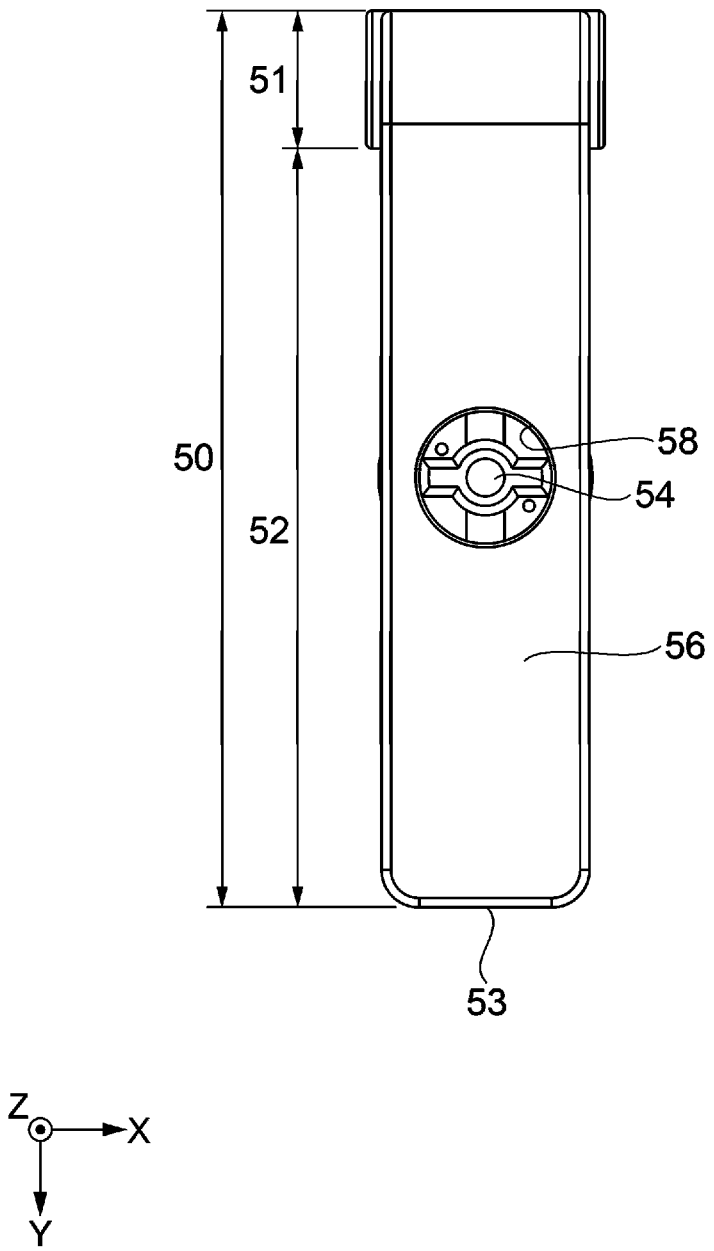
FIG. 7 is a top view of the cap lever.
Figure 8:
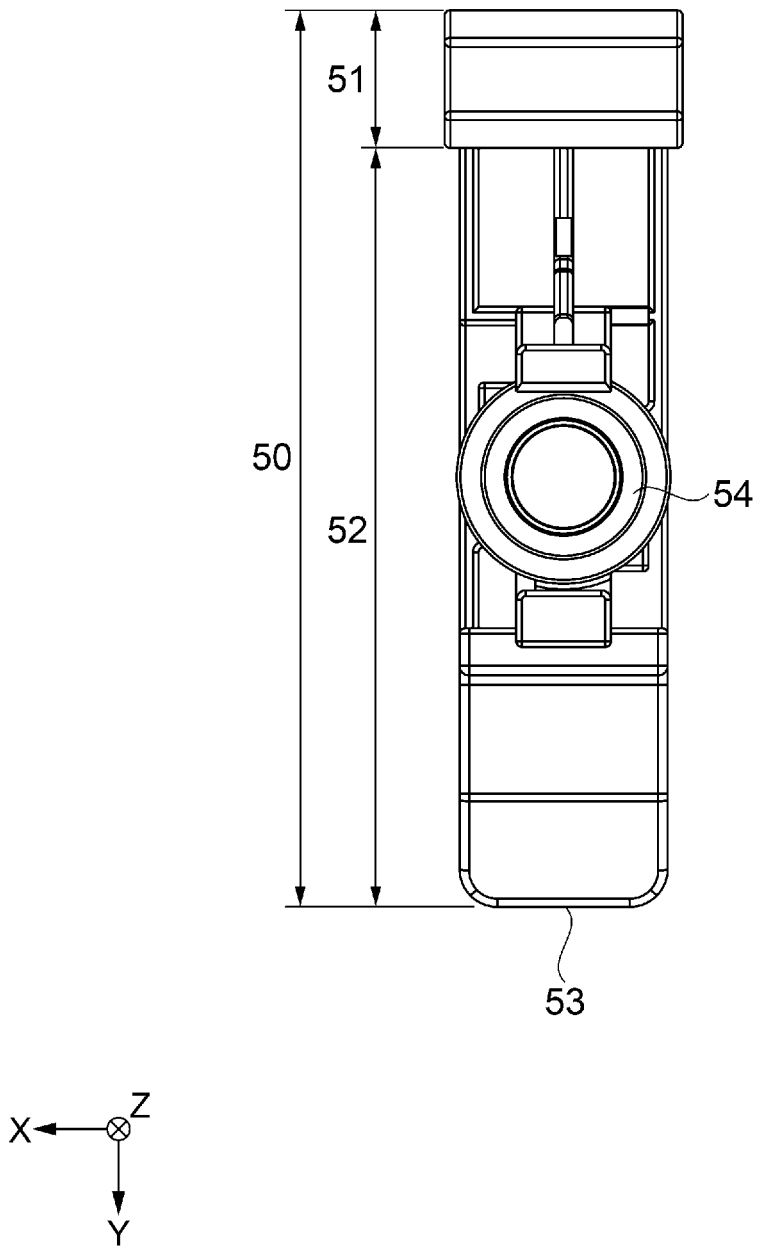
FIG. 8 is a bottom view of the cap lever.
Figure 9:
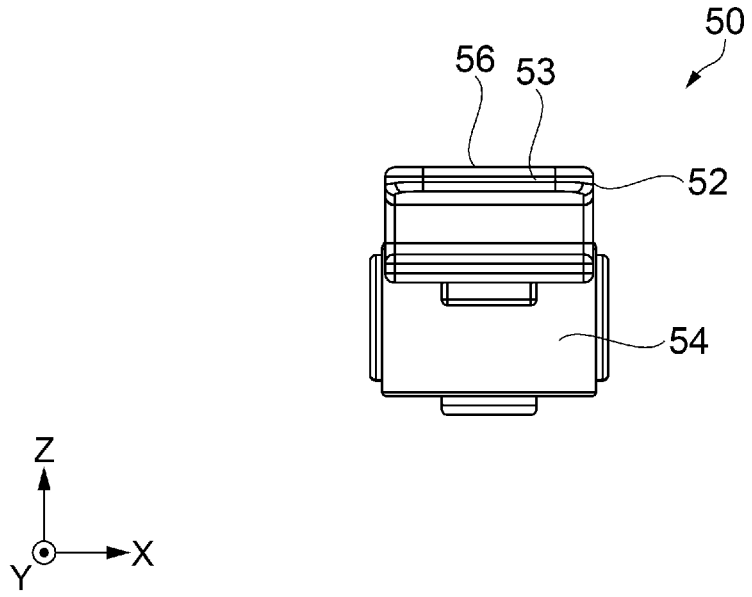
FIG. 9 is a front view of the cap lever.
Figure 10:
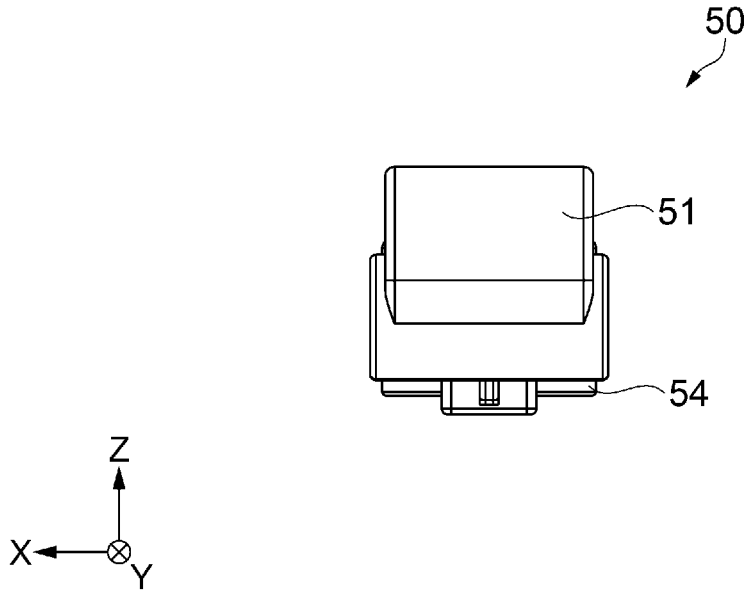
FIG. 10 is a rear view of the cap lever.

FIG. 7 is a top view of the cap lever 50 when viewed from the +Z direction side. FIG. 8 is a bottom view of the cap lever 50 when viewed from the −Z direction side. FIG. 9 is a front view of the cap lever 50 when viewed from the +Y direction side. FIG. 10 is a rear view of the cap lever 50 when viewed from the −Y direction side. FIG. 11 is a right side view of the cap lever 50 when viewed from the +X direction side. FIG. 12 is a left side view of the cap lever 50 when viewed from the −X direction side.

As illustrated in FIGS. 4 and 5, the liquid container device 3 includes the liquid containers 40 each having an inlet 41, through which a liquid can be poured from the replenishment container 90, the casing 30, in which the liquid containers 40 are housed, and the cap levers 50, each of which is configured to pivot and has a cap 54 configured to seal the corresponding inlet 41.

Six liquid containers 40 are contained in the casing 30. The six liquid containers 40 are composed of liquid containers 40K1, 40K2, 40GR, 40C, 40M, and 40Y. The liquid container 40K1 is configured to contain a black liquid containing a black pigment as a color material. The liquid container 40K2 is configured to contain a black liquid containing a black dye as a color material. The liquid container 40GR is configured to contain a gray liquid containing a gray dye as a color material. The liquid container 40C is configured to contain a cyan liquid containing a cyan pigment as a color material. The liquid container 40M is configured to contain a magenta liquid containing a magenta pigment as a color material. The liquid container 40Y is configured to contain a yellow liquid containing a yellow pigment as a color material.

The liquid containers 40K1, 40K2, 40GR, 40C, 40M, and 40Y are disposed in this order in the +X direction.

The number of the liquid containers 40 contained in the casing 30 is not limited to six and may be less than or more than six. The color materials contained in the liquids contained in the liquid containers 40 may be pigments or dyes.

In addition, the liquids contained in the liquid containers 40 may be liquids that do not contain color materials.

Black liquids containing a black pigment as a color material are resistant to spreading and are thus suitable for recording of, for example, characters and markers. Black liquids containing a black dye as a color material have good color reproducibility and are thus suitable for recording of, for example, photographs.

Thus, black liquids containing a black pigment as a color material are used for monochrome printing and for printing of, for example, markers. Black liquids containing a black dye as a color material are used for printing of, for example, photographs. In addition, when a color between white and black is recorded by using a gray liquid containing a gray dye as a color material, the color exhibits improved color reproducibility. Thus, gray liquids containing a gray dye as a color material are used for printing of, for example, photographs.

The inlet 41, through which a liquid can be poured from the replenishment container 90, and an air inlet 45, into which air can be taken, are disposed on an upper surface (surface on the +Z direction side) 42 of each of the liquid containers 40. In addition, the liquid containers 40 each have a visualization surface 43, which projects in the +Y direction and is positioned on the −Z direction side with respect to the upper surface 42. The visualization surface 43 has a graduation portion 44 including a graduation 44*a* indicating that the liquid container 40 is empty of liquid and a graduation 44*b* indicating that the liquid container 40 is full of liquid.

The liquid containers 40 are made of a translucent or transparent material. The liquid contained in each of the liquid containers 40 can be checked from the outside. A user grasps the state of the liquid contained in each of the liquid containers 40 via the visualization surface 43.

As described above, the liquid containers 40 each have the upper surface 42, on which the inlet 41 is disposed, and the visualization surface 43, via which a liquid is visible and which is positioned on the −Z direction side with respect to the upper surface 42.

The casing 30 includes a cover 31, which protects the upper surfaces 42 of the liquid containers 40, a cover-engaging portion 33 and a cap lever-engaging portion 32, which are disposed between the cover 31 and the upper surfaces 42, a visualization portion 34, which has openings 35 exposing the visualization surfaces 43, and a wall portion 36, which is disposed on the +Z direction side with respect to the visualization portion 34. A user can grasp the amounts of remaining liquids contained in the liquid containers 40 by checking the visualization surfaces 43 of the liquid containers 40 via the visualization portion 34 of the casing 30.

The wall portion 36 has an inclined surface 37, which is inclined in the −Y direction toward the +Z direction. An end 38 of the wall portion 36 in the +Z direction is disposed at the end of the inclined surface 37 in the +Z direction.

The end 38 of the wall portion 36 in the +Z direction (end 38 of the inclined surface 37 in the +Z direction) is an example of the end of the wall portion in the direction opposite to the first direction in the present application and is hereinafter referred to as the end 38 of the wall portion 36 in the direction opposite to the first direction.

The wall portion 36 and the liquid containers 40 are disposed so as to overlap each other in the Y direction. As illustrated in FIG. 1, in the state in which the scanner unit 10 is closed, the wall portion 36 and the display unit 15 are disposed so as to overlap each other in the Y direction. In other words, the wall portion 36 is disposed so as to be interposed between the display unit 15 and the liquid containers 40 in the Y direction.

The side surface on the +X direction side of the casing 30 (side surface on the +X direction side of the apparatus body 2) has a cutout portion 8. The length in the Y direction of the cutout portion 8 is substantially equal to the length in the Y direction of the cover 31. The cutout portion 8 is formed so as to be substantially equal in height in the Z direction to the cover 31 in a closed state. As illustrated in FIG. 3, the disposition of the cutout portion 8 in such a manner enables a space in which the replenishment container 90 is inserted into the liquid container 40Y, which is positioned on the +X direction side with respect to the other liquid containers, to be made when the liquid container 40Y is replenished with a liquid. The cutout portion 8 may be formed so as to be substantially equal in height in the Z direction to the surfaces disposed so as to face the cover 31 of the cap levers 50 (described later) in a state in which the cover 31 is open.

The cover-engaging portion 33 is positioned on the +Z direction side with respect to the cap lever-engaging portion 32. Engaging one end of the cover 31 with the cover-engaging portion 33 enables the cover 31 to pivot around the cover-engaging portion 33 as a pivot axis. Specifically, the cover 31 is configured to pivot around the cover-engaging portion 33 as a pivot axis to be in the open state illustrated in FIG. 4 with solid lines or in the closed state illustrated in FIG. 4 with chain double-dashed lines.

When the cover 31 is in the open state, the liquid containers 40 are exposed and can be replenished with a liquid from the replenishment container 90. When the cover 31 is in the closed state, the liquid containers 40 are protected by the cover 31. When the cover 31 is in the closed state, the cover 31 is disposed parallel to the XY-plane (horizontal plane).

The cap lever-engaging portion 32 is an example of an engaging portion in the present application.

As illustrated in FIGS. 6 to 12, the cap lever 50 includes an engageable portion 51, which is positioned on the −Y direction side, and a body 52, which is positioned on the +Y direction side. The body 52 extends in the +Y direction from the engageable portion 51.

The engageable portion 51 is curved in the −Z direction toward the −Y direction, and an end 51*a* of the engageable portion 51 in the −Y direction is engaged with the cap lever-engaging portion 32 of the casing 30. Engaging the end 51*a* of the engageable portion 51 in the −Y direction with the cap lever-engaging portion 32 of the casing 30 enables the cap lever 50 to pivot around the cap lever-engaging portion 32 as a pivot axis.

As described above, the cap lever 50 includes the engageable portion 51, which is configured to be engaged with the cap lever-engaging portion 32, and the body 52, which extends in the +Y direction from the engageable portion 51.

In FIG. 2, the cap levers 50 are disposed so as to seal the respective inlets 41 of the liquid containers 40K1, 40K2, 40GR, 40C, and 40M, and the cap lever 50 is disposed such that the inlet 41 of the liquid container 40Y is open. As illustrated in FIG. 2, the cap levers 50 are each configured to pivot around the cap lever-engaging portion 32 as a pivot axis to be in the closed state in which the inlet 41 of the liquid container 40 is sealed or in the open state in which the inlet 41 of the liquid container 40 is open.

As illustrated in FIG. 3, when the cap lever 50 is in the open state, the inlet 41 of the liquid container 40 is open, and the liquid container 40 can be replenished with a liquid from the replenishment container 90. When the cap lever 50 is in the closed state, the cap lever 50 is disposed parallel to the XY-plane (horizontal plane).

Returning to FIGS. 6 to 12, the body 52 of the cap lever 50 has a surface 56, which is disposed on the +Z direction side, and an end 53, which is on the +Y direction side. The surface 56 of the body 52 of the cap lever 50 is planar. When the cap lever 50 is in the closed state, the surface 56 of the body 52 of the cap lever 50 is disposed parallel to the XY-plane (horizontal plane). When the cover 31 and the cap lever 50 are each in the closed state, the surface 56 of the body 52 of the cap lever 50 is disposed so as to face the cover 31.

As described above, the surface 56 of the body 52 of the cap lever 50 is disposed so as to face the cover 31 and is an example of the surface disposed so as to face the cover of the body in the present application. The end 53 on the +Y direction side of the body 52 of the cap lever 50 is an example of the end of the body in the second direction in the present application and is hereinafter referred to as the end 53 of the body 52 in the second direction.

The body 52 of the cap lever 50 has a hole 58 passing through the body 52. The cap 54 is fit into the hole 58 of the body 52 and is fixed to the body 52. In the state in which the cap 54 is fit into the hole 58, the cap 54 is disposed on the surface opposite to the surface 56, and the end on the +Z direction side of the cap 54 does not project from the surface 56.

When the cap lever 50 is in the closed state, the cap 54 is disposed on the −Z direction side with respect to the surface 56 of the body 52. In addition, the engageable portion 51 is curved in the −Z direction toward the −Y direction. Thus, when the cap lever 50 is in the closed state, the engageable portion 51 is disposed on the −Z direction side with respect to the surface 56 of the body 52.

As described above, when the cap lever 50 is in the closed state, the cap 54 and the engageable portion 51 are disposed on the −Z direction side with respect to the surface 56 of the body 52 and do not project in the +Z direction with respect to the surface 56 of the body 52. Thus, compared with the configuration in which the cap 54 and the engageable portion 51 project in the +Z direction with respect to the surface 56 of the body 52, it is possible to reduce the length in the height direction (length in the Z direction) of the liquid container device 3 and to reduce the size of the liquid container device 3 in the height direction (Z direction).

FIG. 13 illustrates a state in which the cover 31 and the cap lever 50 are closed.

As illustrated in FIG. 13, when the cover 31 and the cap lever 50 are each in the closed state, the surface 56 of the body 52 is disposed so as to face the cover 31.

When a component projecting in the +Z direction from the surface 56 of the body 52 is disposed, for example, when a knob that can be held is disposed so as to project from the surface 56 of the body 52, it is difficult to dispose the cap lever 50 close to the cover 31. The component projecting in the +Z direction from the surface 56 of the body 52 is an obstacle that hinders the reduction of the length in the height direction of the liquid container device 3. Thus, it is difficult to reduce the size of the liquid container device 3 in the height direction.

In the present embodiment, the surface 56, which is disposed so as to face the cover 31, is planar. In addition, a component projecting in the +Z direction from the surface 56 of the body 52 is not disposed. Thus, it is possible to dispose the cap lever 50 close to the cover 31 and to reduce the length in the height direction of the liquid container device 3. As a result, it is possible to reduce the size of the liquid container device 3 in the height direction.

A surface 39 of the cover 31, which is disposed so as to face the surface 56 of the body 52, is planar. In addition, a projection 39*a*, which projects from the surface 39, is disposed on the surface 39 of the cover 31.

When the cover 31 and the cap lever 50 are each in the closed state, the projection 39*a* of the cover 31 is in line contact with the surface 56 of the body 52, the cover 31 and the cap lever 50 are disposed with a uniform distance therebetween, and the surface 39 of the cover 31 and the surface 56 of the body 52 are disposed along a horizontal plane. When a user has forgotten to close the cap lever 50, the cap lever 50 can be securely closed by closing the cover 31 having the projection 39*a*. In addition, the cover 31 having the projection 39*a* can inhibit lifting of the cap lever 50 that may occur due to vibrations generated during, for example, transportation.

Figure 14:
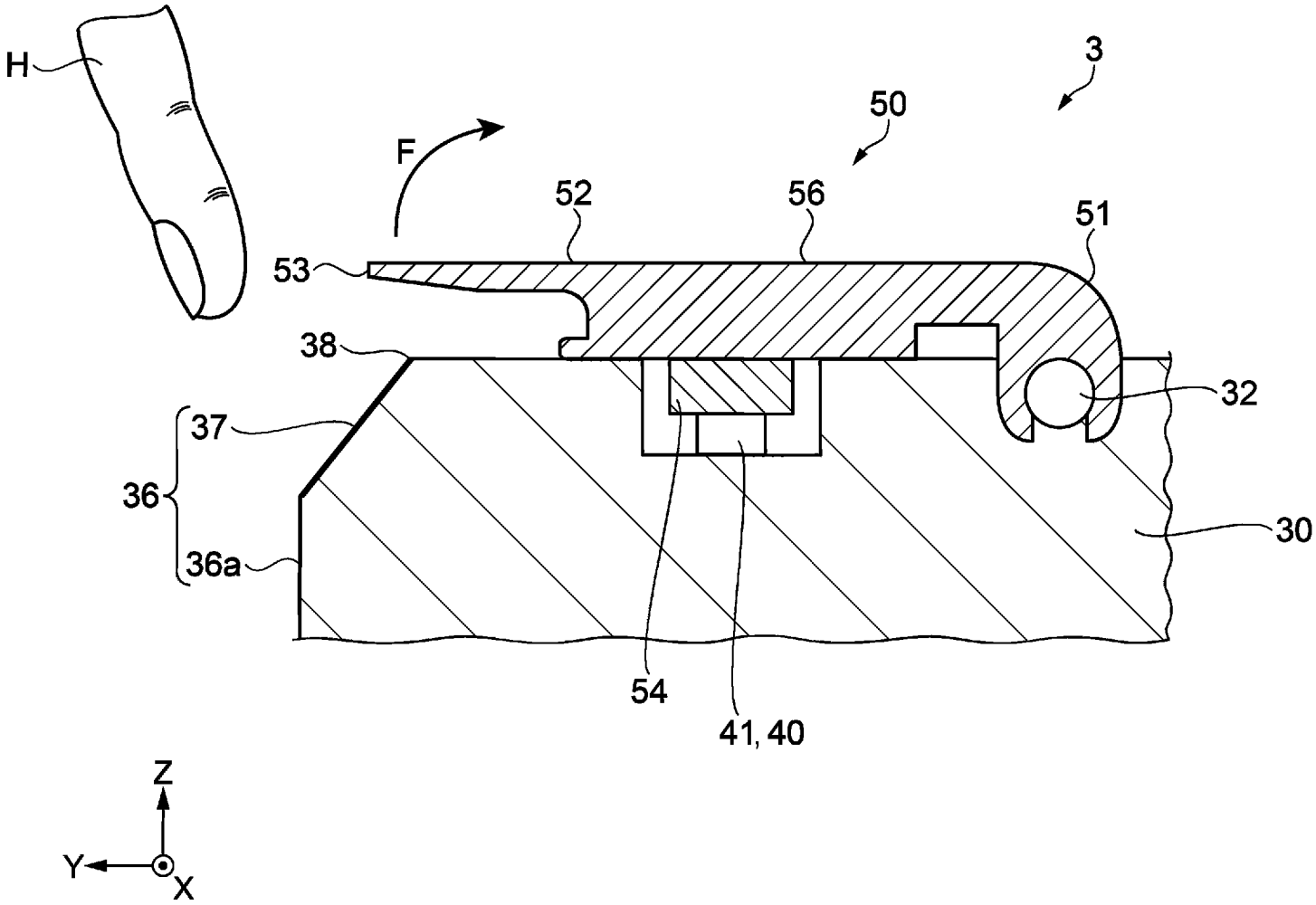
FIG. 14 is a sectional view of the liquid container device in a state in which a cover is open and the cap lever is closed.

FIG. 14 corresponds to FIG. 13 and is a sectional view schematically illustrating the liquid container device 3 in a state in which the cover 31 is open and the cap lever 50 is closed. FIG. 14 does not illustrate the cover 31.

When the amount of remaining liquid contained in the liquid container 40 becomes small, and a user replenishes the liquid container 40 with a liquid from the replenishment container 90, the user first opens the cover 31 in the closed state. Then, the user opens the cap lever 50 in the closed state, opens the inlet 41 of the liquid container 40 in the sealed state, inserts the tip (inlet) of the replenishment container 90 into the inlet 41 of the liquid container 40, and replenishes the liquid container 40 with a liquid from the replenishment container 90.

FIG. 14 illustrates a case in which a user opens the cap lever 50 in the closed state to replenish the liquid container 40 with a liquid from the replenishment container 90.

As illustrated in FIG. 14, the wall portion 36 of the casing 30 has a body 36*a*, which is disposed in the Z direction, and the inclined surface 37, which extends in the +Z direction from the body 36*a*. FIG. 14 illustrates the body 36*a* with a thin solid line and the inclined surface 37 with a thick solid line.

The body 36*a* is a portion projecting in the +Y direction of the wall portion 36. The inclined surface 37 is inclined in the −Y direction toward the +Z direction. That is, the surface inclined in the −Y direction toward the +Z direction of the wall portion 36 is the inclined surface 37. The end of the inclined surface 37 in the +Z direction is the end 38 of the wall portion 36 in the direction opposite to the first direction. That is, the end 38 of the wall portion 36 in the direction opposite to the first direction is disposed at the end of the inclined surface 37 in the +Z direction.

The end 53 of the body 52 of the cap lever 50 in the second direction is positioned on the +Z direction side with respect to the end 38 of the wall portion 36 of the casing 30 in the direction opposite to the first direction. The end 53 of the body 52 of the cap lever 50 in the second direction is separated from the end 38 of the wall portion 36 in the direction opposite to the first direction. In addition, the end 53 of the body 52 in the second direction projects in the +Y direction with respect to the end 38 of the wall portion 36 in the direction opposite to the first direction.

The end 53 of the body 52 in the second direction does not project in the +Y direction with respect to the body 36*a* of the wall portion 36. The end 53 of the body 52 in the second direction is disposed, in the Y direction, between the body 36*a* of the wall portion 36 and the end 38 of the wall portion 36 in the direction opposite to the first direction.

Compared with the configuration in which the end 53 of the body 52 in the second direction projects in the +Y direction with respect to the body 36*a* of the wall portion 36, the configuration in which the end 53 of the body 52 in the second direction does not project in the +Y direction with respect to the body 36*a* of the wall portion 36 can reduce the length in the Y direction (depth direction) of the liquid container device 3 and can reduce the size of the liquid container device 3 in the depth direction.

The inclined surface 37 of the wall portion 36 is inclined in the −Z direction toward the +Y direction relative to the end 38 of the wall portion 36 in the direction opposite to the first direction. As a result, toward the +Y direction, the wall portion 36 is more separated from the body 52 of the cap lever 50, and the space between the wall portion 36 and the body 52 becomes wider.

Compared with the configuration in which the wall portion 36 does not have the inclined surface 37, the configuration in which the wall portion 36 has the inclined surface 37 enables a wide space to be formed on the +Y direction side with respect to the cap lever 50.

A user inserts a finger H, from the +Y direction side with respect to the cap lever 50, into the wide space formed on the +Y direction side with respect to the cap lever 50, and the finger H comes into contact with the end 53 of the body 52 in the second direction. Since the space between the wall portion 36 and the body 52 becomes wider toward the +Y direction, the finger H of the user can come into contact with the end 53 of the body 52 in the second direction without coming into contact with the wall portion 36 (casing 30). Subsequently, the user applies force F, whose direction is represented by an arrow in FIG. 14, to the end 53 of the body 52 in the second direction, pivots the cap lever 50, and opens the cap lever 50 in the closed state.

The end 53 of the body 52 in the second direction, to which the force F is applied, is a point of application to which force for pivoting the cap lever 50 is applied. The cap lever-engaging portion 32, which supports the cap lever 50, is a fulcrum for pivoting the cap lever 50.

In the present embodiment, the point of application to which force for pivoting the cap lever 50 is applied (end 53 of the body 52 in the second direction) is farthest from the fulcrum for pivoting the cap lever 50 (cap lever-engaging portion 32). Thus, by using the principle of the lever, the user can easily pivot the cap lever 50 with small force and open and close the cap lever 50. As a result, the usability of the liquid container device 3 is improved.

In addition, when the user pivots and opens or closes the cap lever 50, the finger H does not come into contact with the casing 30. Thus, excessive force is not applied to the casing 30, and failures due to application of excessive force (for example, deformation of the casing 30) are unlikely to occur. As a result, the reliability of the liquid container device 3 is improved.

A user opens or closes the cap lever 50 by utilizing the space formed on the +Y direction side with respect to the cap lever 50, that is, the space formed on the lateral direction (Y direction) side with respect to the cap lever 50. Thus, compared with a case in which a user opens or closes the cap lever 50 by utilizing a space formed on the height direction (Z direction) side with respect to the cap lever 50, adverse effect is unlikely to be caused to the opening and closing operation of the cap lever 50 even if the space on the height direction side is small. As a result, it is possible to reduce the length in the height direction of the liquid container device 3 and to reduce the size of the liquid container device 3 in the height direction.

As described above, the liquid container device 3 according to the present embodiment has the following configuration. The liquid container 40 has the upper surface 42, on which the inlet 41 is disposed, and the visualization surface 43, via which a liquid is visible. The casing 30 includes the cover 31, which is configured to pivot, the cap lever-engaging portion 32, the visualization portion 34, and the wall portion 36. The cap lever 50 includes the engageable portion 51, which is configured to be engaged with the cap lever-engaging portion 32, and the body 52. The surface 56, which is disposed so as to face the cover 31, of the body 52 is planar. The end 53 of the body 52 in the second direction is separated from the end 38 of the wall portion 36 in the direction opposite to the first direction.

Such a configuration can reduce the length in the height direction of the liquid container device 3 and can reduce the size of the liquid container device 3 in the height direction.

In addition, the liquid container device 3 according to the present embodiment has the following configuration. The wall portion 36 has the inclined surface 37, which is inclined in the −Y direction toward the +Z direction. The end 38 of the wall portion 36 in the direction opposite to the first direction is disposed at the end of the inclined surface 37 in the direction opposite to the first direction. In addition, the liquid container device 3 according to the present embodiment has the following configuration. The end 53 of the body 52 in the second direction projects in the +Y direction with respect to the end 38 of the wall portion 36 in the direction opposite to the first direction.

Such a configuration enables a user to easily open and close the cap lever 50 when the user replenishes the liquid container 40 with a liquid from the replenishment container 90. Thus, failures due to application of excessive force (for example, deformation of the casing 30) are unlikely to occur. As a result, the usability and the reliability of the liquid container device 3 are improved.

2. Embodiment 2

An overview of a liquid container device 3A in Embodiment 2 is described with reference to FIG. 15 below with the focus on the differences between Embodiment 1 and Embodiment 2. The same components as those in Embodiment 1 have the same reference signs, and duplicate descriptions are omitted.

The liquid container device 3A in the present embodiment differs from the liquid container device 3 in Embodiment 1 in the shape of the cap lever. The other configurations of the liquid container device 3A are the same as those of the liquid container device 3.

Figure 15:
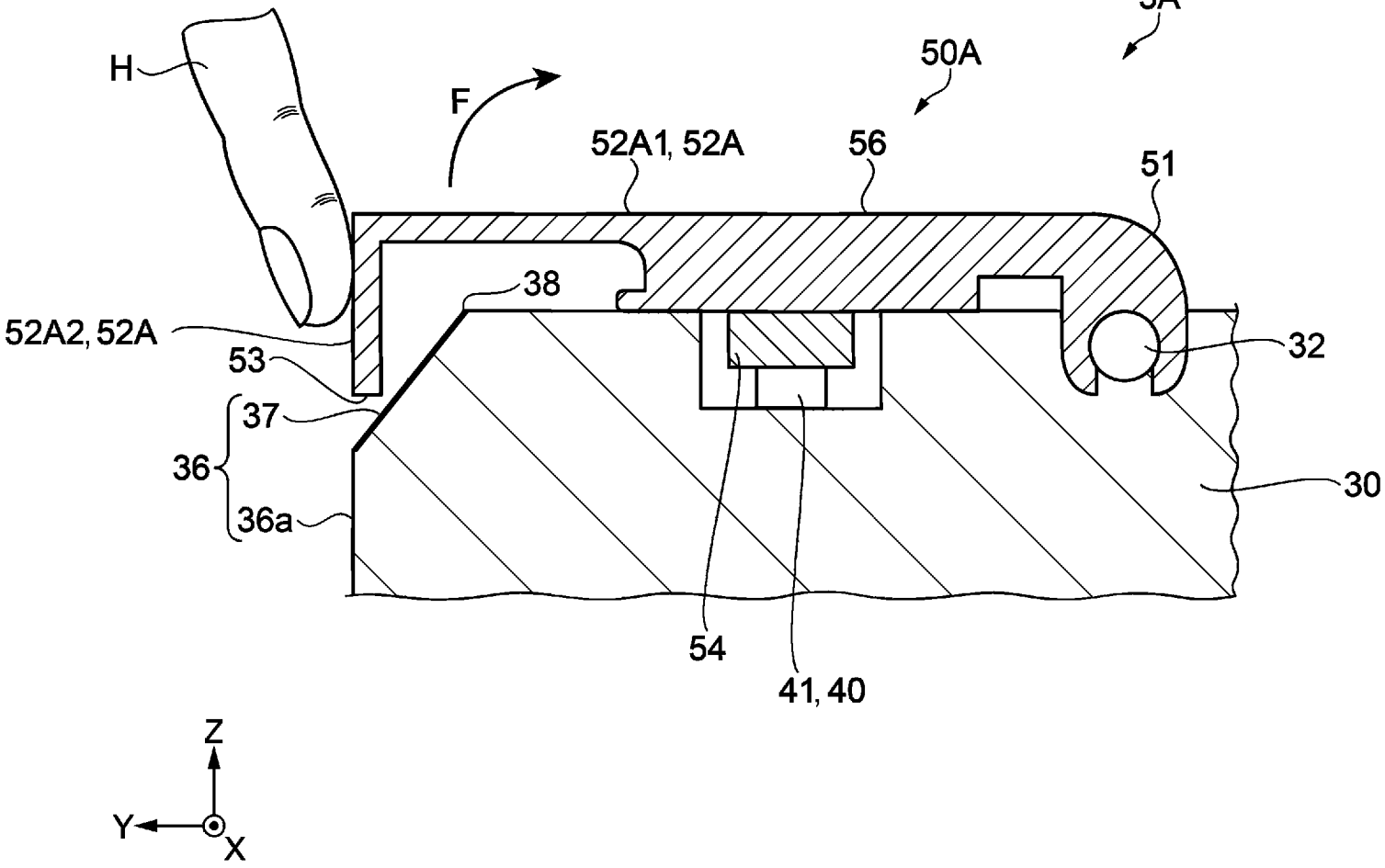
FIG. 15 is a sectional view of a liquid container device according to Embodiment 2.

As illustrated in FIG. 15, the liquid container device 3A in the present embodiment includes a cap lever 50A, the casing 30 in Embodiment 1, and the liquid container 40 in Embodiment 1.

The cap lever 50A includes the engageable portion 51, which is configured to be engaged with the cap lever-engaging portion 32, and a body 52A, which extends in the +Y direction from the engageable portion 51. The body 52A includes a portion 52A1, which extends in the +Y direction from the engageable portion 51, and a portion 52A2, which is bent in the −Z direction from the portion 52A1. The end of the portion 52A2 in the −Z direction is the end 53 of the body 52A in the second direction.

As described above, in the present embodiment, the end 53 of the body 52A of the cap lever 50A in the second direction is bent in the −Z direction.

Such a configuration enables a user to insert a finger H from the +Y direction side with respect to the cap lever 50A, make the finger H come into contact with the portion 52A2 of the body 52A without the finger H coming into contact with the wall portion 36, apply force F, whose direction is represented by an arrow in FIG. 15, to the portion 52A2 of the body 52A, pivot the cap lever 50A, and open or close the cap lever 50A. The point of application to which force for pivoting the cap lever 50A is applied (portion 52A2 of the body 52A) is farthest from the fulcrum for pivoting the cap lever 50A (cap lever-engaging portion 32). Thus, by using the principle of the lever, the user can easily open and close the cap lever 50A with small force. As a result, the usability of the liquid container device 3A is improved. In addition, the reliability of the liquid container device 3A is improved, and thus it is possible to achieve an effect similar to that in Embodiment 1 in which the liquid container device 3A can be reduced in size in the height direction of the liquid container device 3A.

3. Embodiment 3

An overview of a liquid container device 3B in Embodiment 3 is described with reference to FIG. 16 below with the focus on the differences between Embodiment 1 and Embodiment 3. The same components as those in Embodiment 1 have the same reference signs, and duplicate descriptions are omitted.

The liquid container device 3B in the present embodiment differs from the liquid container device 3 in Embodiment 1 in the shape of a wall portion 36B. The other configurations of the liquid container device 3B are the same as those of the liquid container device 3.

Figure 16:
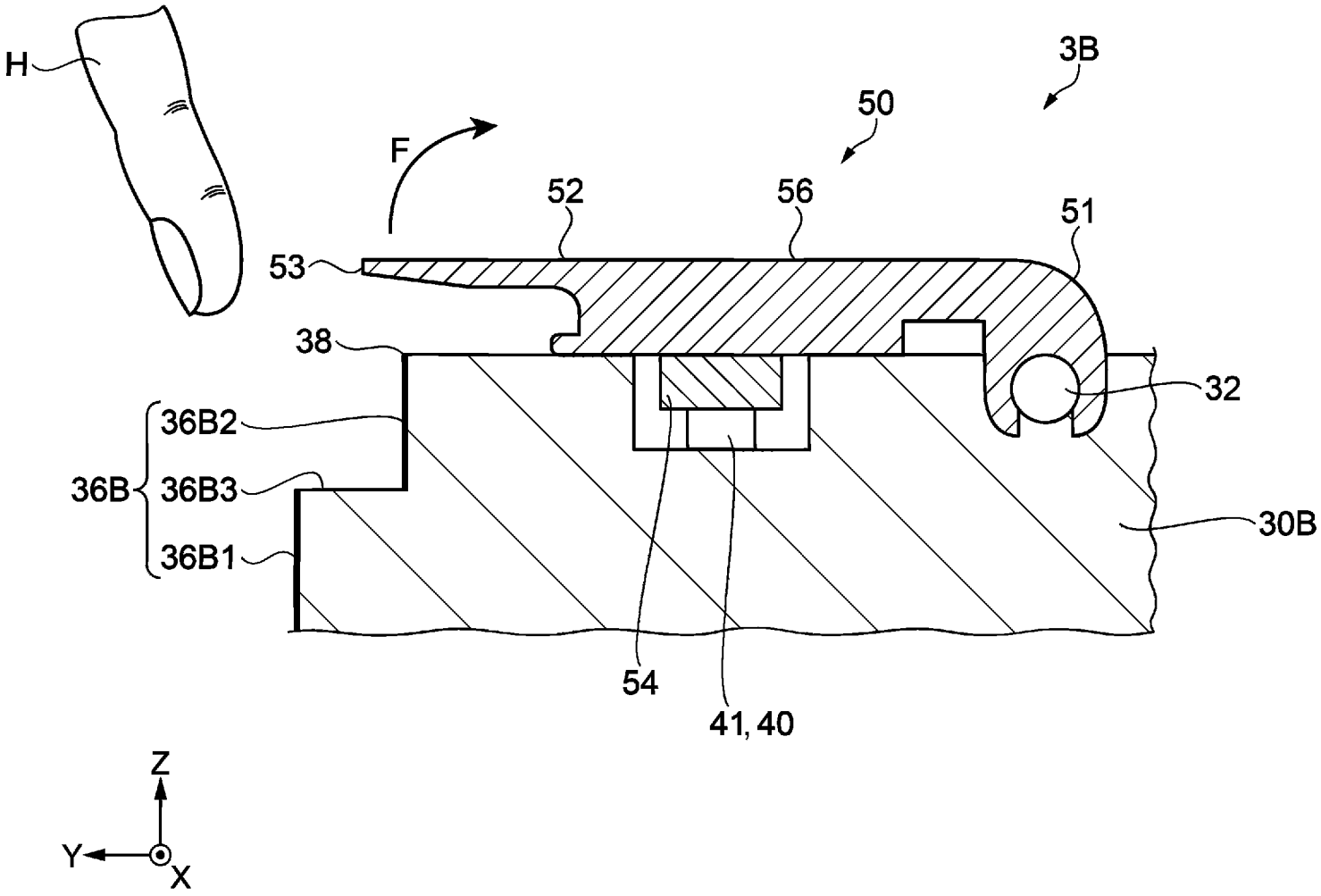
FIG. 16 is a sectional view of a liquid container device according to Embodiment 3.

As illustrated in FIG. 16, the liquid container device 3B in the present embodiment includes the cap lever 50 in Embodiment 1, a casing 30B, and the liquid container 40 in Embodiment 1.

The wall portion 36B of the casing 30B includes a first portion 36B1, which projects in the +Y direction, and a second portion 36B2, which is positioned on the +Z direction side and recessed in the −Y direction with respect to the first portion 36B1. FIG. 16 illustrates the first portion 36B1 and the second portion 36B2 with thick solid lines. The second portion 36B2, which is recessed in the −Y direction, is separated from the first portion 36B1 and positioned on the +Z direction side. The end 38 of the wall portion 36B in the direction opposite to the first direction is disposed at the end of the second portion 36B2 in the +Z direction.

By disposing the first portion 36B1 and the second portion 36B2, which is positioned on the +Z direction side with respect to the first portion 36B1, a third portion 36B3, which is recessed in the −Z direction with respect to the second portion 36B2, is formed between the first portion 36B1 and the second portion 36B2.

As a result, a wide space is formed on the +Y direction side with respect to the cap lever 50.

A user inserts a finger H, from the +Y direction side with respect to the cap lever 50, into the wide space formed on the +Y direction side with respect to the cap lever 50, and the finger H comes into contact with the end 53 of the body 52 in the second direction. Since the wide space is formed on the +Y direction side with respect to the cap lever 50, the finger H of the user can come into contact with the end 53 of the body 52 in the second direction without coming into contact with the wall portion 36B (casing 30B). Subsequently, the user applies force F, whose direction is represented by an arrow in FIG. 16, to the end 53 of the body 52 in the second direction, pivots the cap lever 50, and opens the cap lever 50 in the closed state.

As a result, when the user replenishes the liquid container 40 with a liquid from the replenishment container 90, the user easily opens or closes the cap lever 50. Thus, it is possible to achieve an effect similar to that in Embodiment 1 in which the usability of the liquid container device 3B is improved.

In addition, when the user pivots and opens or closes the cap lever 50, the finger H does not come into contact with the casing 30B. Thus, excessive force is not applied to the casing 30B, and failures due to application of excessive force (for example, deformation of the casing 30B) are unlikely to occur. As a result, the reliability of the liquid container device 3B is improved.

In addition, it is possible to achieve an effect similar to that in Embodiment 1 in which the liquid container device 3B can be reduced in size in the height direction of the liquid container device 3B.

4. Embodiment 4

The same components as those in Embodiment 1 to Embodiment 3 have the same reference signs, and duplicate descriptions are omitted.

Figure 17:
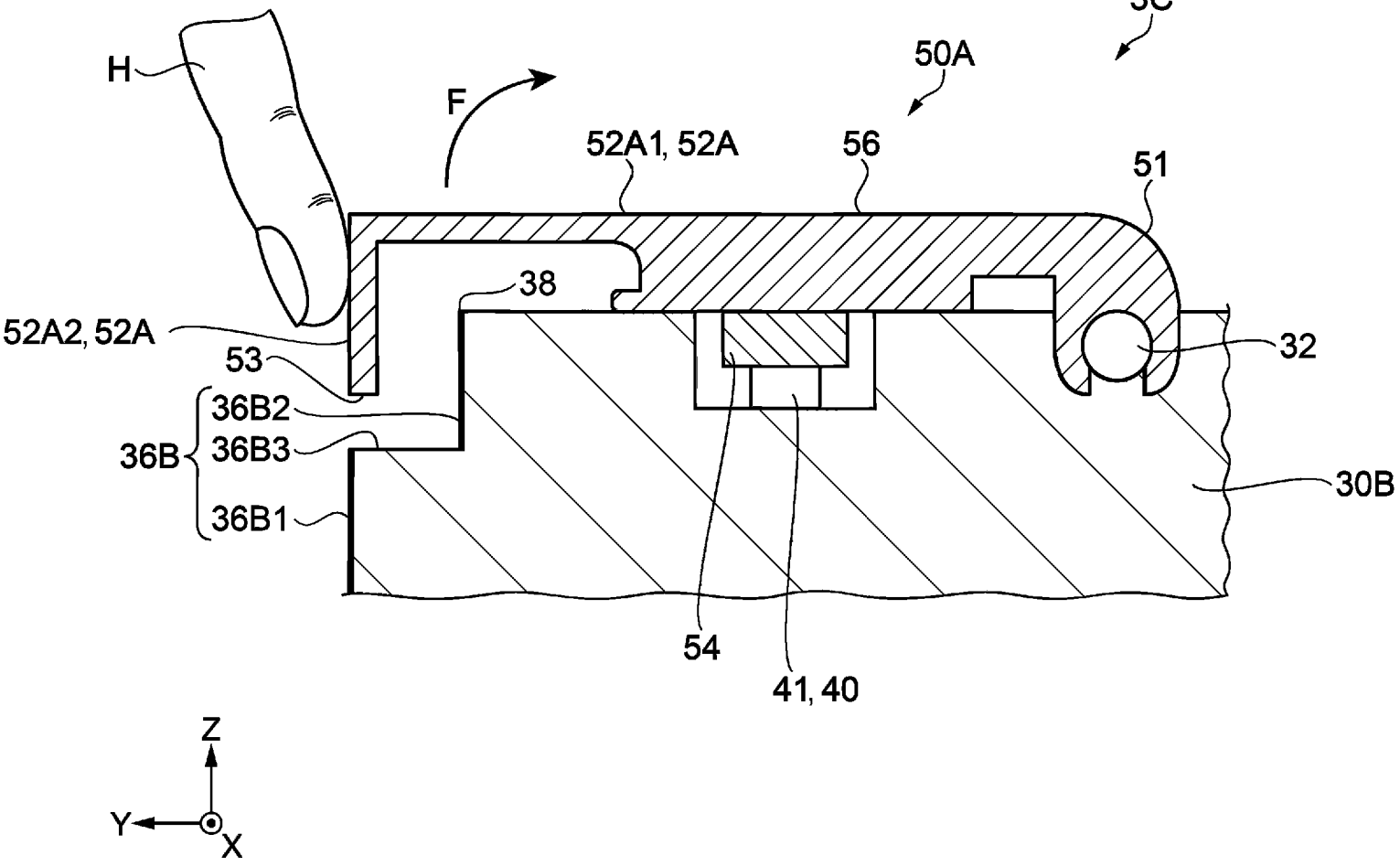
FIG. 17 is a sectional view of a liquid container device according to Embodiment 4.

As illustrated in FIG. 17, a liquid container device 3C in Embodiment 4 includes the cap lever 50A in Embodiment 2, the casing 30B in Embodiment 3, and the liquid container 40 in Embodiment 1.

Such a configuration also enables a user to insert a finger H from the +Y direction side with respect to the cap lever 50A, make the finger H come into contact with the portion 52A2 of the body 52A without the finger H coming into contact with the wall portion 36B, apply force F, whose direction is represented by an arrow in FIG. 17, to the body 52A, pivot the cap lever 50A, and open the cap lever 50A in the closed state.

As a result, when the user replenishes the liquid container 40 with a liquid from the replenishment container 90, the user easily opens or closes the cap lever 50A. Thus, the usability of the liquid container device 3C is improved. In addition, the reliability of the liquid container device 3C is improved, and thus it is possible to achieve an effect similar to that in Embodiment 1 to Embodiment 3 in which the liquid container device 3C can be reduced in size in the height direction of the liquid container device 3C.

5. Embodiment 5

In the above embodiments, the wall portion 36, which has the inclined surface 37, or the wall portion 36B, which includes the first portion 36B1 and the second portion 36B2, is disposed on the casing 30. The following configuration may also be applied. The wall portion 36, which has the inclined surface 37, or the wall portion 36B, which includes the first portion 36B1 and the second portion 36B2, is not disposed on the casing 30 but is disposed on the liquid container 40.

For example, when a component (for example, the wall portion 36 in Embodiment 1) that hinders a finger H from being inserted from the +Y direction side with respect to the liquid container 40 is not disposed on the casing 30, and the wall portion 36, which has the inclined surface 37, or the wall portion 36B, which includes the first portion 36B1 and the second portion 36B2, is disposed on the liquid container 40, the usability and the reliability of the liquid container device are improved. Thus, it is possible to achieve an effect similar to that in Embodiment 1 to Embodiment 4 in which the liquid container device can be reduced in size in the height direction of the liquid container device.

What is claimed is:

1. A liquid container device comprising:

a liquid container having an inlet through which a liquid is poured from a replenishment container;

a casing in which the liquid container is housed; and a cap lever configured to pivot and having a cap configured to seal the inlet, wherein the liquid container has an upper surface on which the inlet is disposed, and a visualization surface via which the liquid is visible and that is positioned on a side of a first direction with respect to the upper surface, the casing includes a cover that is configured to pivot and that protects the upper surface, an engaging portion disposed between the cover and the upper surface, a visualization portion having an opening exposing the visualization surface, and a wall portion disposed on a side of a direction opposite to the first direction with respect to the visualization portion, the cap lever includes an engageable portion configured to be engaged with the engaging portion, and a body extending in a second direction crossing the first direction from the engageable portion, a surface of the body is planar and is disposed so as to face the cover, and an end of the body in the second direction is separated from an end of the wall portion in the direction opposite to the first direction, wherein the wall portion has an inclined surface inclined in a direction opposite to the second direction toward the direction opposite to the first direction, and the end of the wall portion in the direction opposite to the first direction is disposed at an end of the inclined surface in the direction opposite to the first direction.

2. The liquid container device according to claim 1, wherein the wall portion includes a first portion projecting in the second direction, and a second portion that is positioned on the side of the direction opposite to the first direction with respect to the first portion and that is recessed in a direction opposite to the second direction with respect to the first portion, and the end of the wall portion in the direction opposite to the first direction is disposed at an end of the second portion in the direction opposite to the first direction.

3. The liquid container device according to claim 1, wherein the end of the body in the second direction projects in the second direction with respect to the end of the wall portion in the direction opposite to the first direction.

4. The liquid container device according to claim 1, wherein the end of the body in the second direction is bent in the first direction.

5. The liquid container device according to claim 1, wherein the engageable portion is curved in the first direction toward a direction opposite to the second direction, and an end of the engageable portion in the direction opposite to the second direction is engaged with the engaging portion.

6. A liquid ejecting apparatus comprising:

a liquid ejecting unit configured to eject a liquid; and the liquid container device according to claim 1, in which the liquid is contained.

* * * * *